United States Patent [19]

Eberhardt et al.

[11] 4,093,005

[45] June 6, 1978

[54] CABLE TIE GUN

[75] Inventors: Robert M. Eberhardt, Park Ridge; James Arthur McNana, Burbank; Dennis M. Heuer, Chicago, all of Ill.

[73] Assignee: All States Plastic Manufacturing Co. Inc., Chicago, Ill.

[21] Appl. No.: 772,569

[22] Filed: Feb. 28, 1977

[51] Int. Cl.[2] ..... B21F 9/02

[52] U.S. Cl. ..... 140/123.6; 140/93.2

[58] Field of Search ..... 140/93 A, 93.2, 123.6

[56] References Cited

U.S. PATENT DOCUMENTS

| | | | |
|---|---|---|---|
| 3,438,406 | 4/1969 | Rozmus | 140/123.6 |
| 3,830,263 | 8/1974 | Benfer | 140/123.6 |
| 3,853,155 | 12/1974 | Kabel | 140/123.6 |

*Primary Examiner*—Lowell A. Larson

*Attorney, Agent, or Firm*—Charles A. Laff; J. Warren Whitesel; Howard B. Rockman

[57] ABSTRACT

The inventive cable tie gun uses simple slides and lever arms and does not require common linkages, toggles, or other complex mechanical actions that are subject to malfunction. Near the end of the tensioning slide travel, there is a mechanical interference between two moving parts (i.e. between a cable tensioning slide and a cable severing lever arm having a blade attached thereto.) However, if the cable tie tension exceeds the pulling capability of the tensioning slide, one of the moving parts is immobilized and the interference does not occur. Thereafter, the cable severing lever arm may take a full stroke and cut off the strap end while the tensioning slide is being held at midstroke position by the tension in the cable tie strap. The performance of the cable tie gun is greatly improved by a correct choice of cam surfaces, whereby the parts help and do not oppose each other.

17 Claims, 13 Drawing Figures

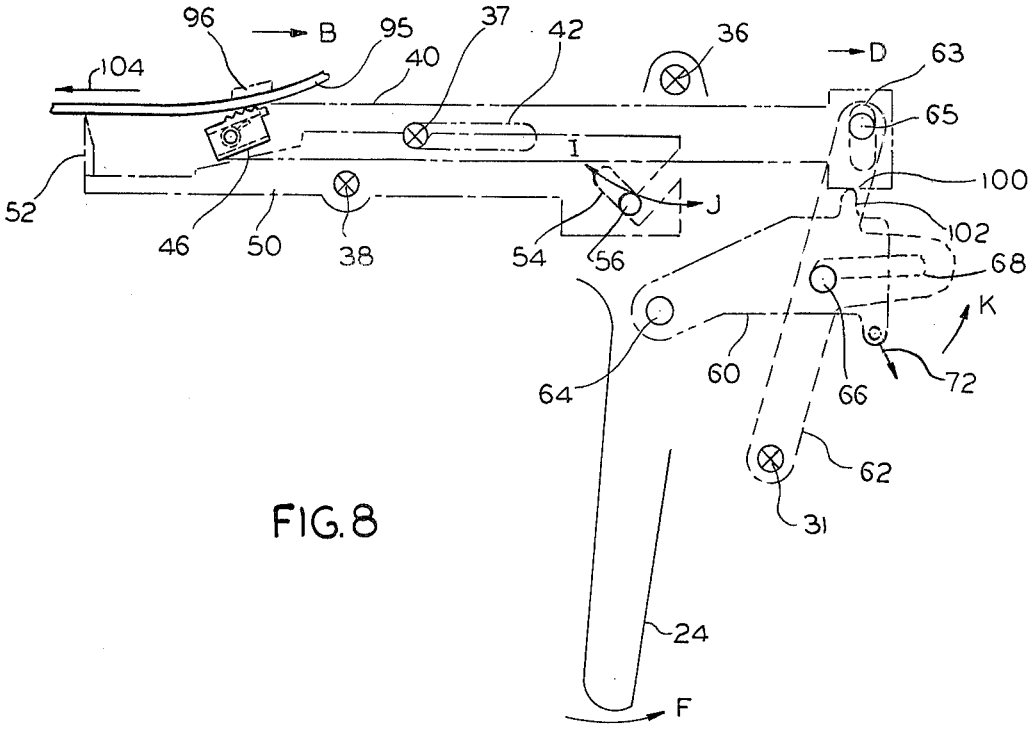
FIG. 8
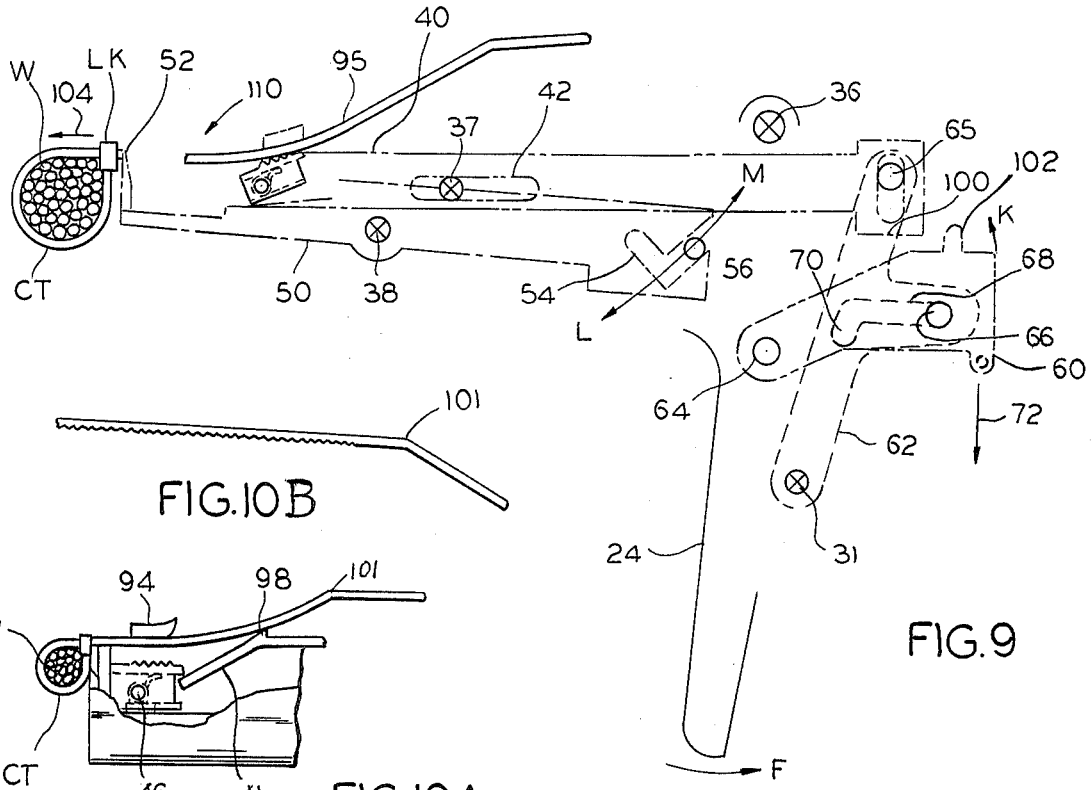
FIG. 9
FIG. 10B
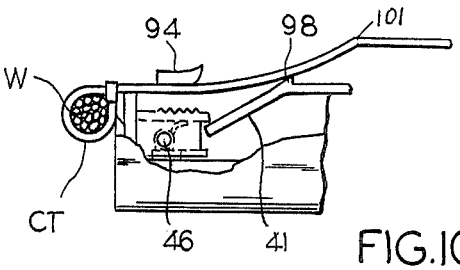
FIG. 10A

CABLE TIE GUN

This invention relates to hand tools and more particularly to cable tie guns for automatically drawing the tie to a predetermined tension and then cutting off the excess strap.

Primarily cable ties are used to bundle and tie together a number of electric wires, thereby forming a cable harness. These cable ties are unitary plastic parts comprising a strap terminated at one end in a locking device. A rack of transverse teeth extend longitudinally along the length of the strap. Very often, the locking device might include a series of teeth which lock into the strap teeth. Therefore, the end of the strap may be wrapped around a bundle of wires, passed through the locking device, and pulled tightly to a predetermined tension. Then, the excess strap is clipped off near the locking device to leave only the plastic strap wrappingly locked around the bundle of wires.

A cable tie gun is a device in the general shape and form of a hand pistol. After the strap is passed through the locking device, the end of the cable tie strap is placed in the barrel of the gun. Then the trigger is squeezed repeatedly to draw the cable tie to a predetermined tension. When the predetermined tension is reached (and not before), the excess strap is cut off near the locking device.

While cable tie guns have been known in the past, they have presented some problems. Some of the guns have rather large cross section barrels, cutters above the strap, or the like, so that there is a clumsy "feel". Regardless of whether the clumsy feel is mechanical or psychological, people do not like to use it. Other of the guns have complex crank arms, toggle linkages, selector switches and the like, so that they are unduly expensive or are subject to wear or breakdown. The guns with heavy parts and unduly complicated mechanisms also add friction and therefore tend to tire the workers.

Accordingly, an object of the invention is to provide new and improved cable tie guns. Here, an object is to provide cable tie guns with a slim silhouette, a good balance, and a non-clumsy feel.

Another object is to provide cable tie guns which insure a predetermined strap tension, with a cut-off near the locking device after the tension is reached.

Another object of the invention is to eliminate toggle switches, multipurpose linkages, and similar sources of excessive wear and cost, and the source of worker tiring friction.

In keeping with an aspect of this invention, a cable tie gun uses simple slides and lever arms which do not require common linkages, toggles, or other complex mechanical actions that are subject to malfunction. Near the end of the tensioning slide travel, there is a mechanical interference between two moving parts which are a cable tensioning slide and a cable severing lever arm actuator. However, if the cable tie tension exceeds the pulling capability of the tensioning slide, the tensioning slide is held immobile so that the interference does not occur. Thus, the cable severing lever arm may thereafter take a full stroke and cut off the strap end while the tensioning slide is being held by the tension in the cable tie strap.

The nature of a preferred embodiment may be understood best from the attached drawing, wherein:

FIG. 8 is a schematic diagram showing some of the parts seen in FIG. 4, in a position which shows the mechanical interference of two moving parts that limits the pretensioned stroke and prevents premature severing of the cable tie;

FIG. 9 is a schematic diagram similar to FIG. 8 which shows an immobilization of one moving part in order to prevent the mechanical interference, enabling strap severance after the desired tension is achieved thereby; and FIGS. 10A and B show two possible positions of the bent end of a cable tie, which is one embodiment of cable ties that may be used in connection with the inventive gun.

Figures 1A, 1B, 1C, 2, 3:
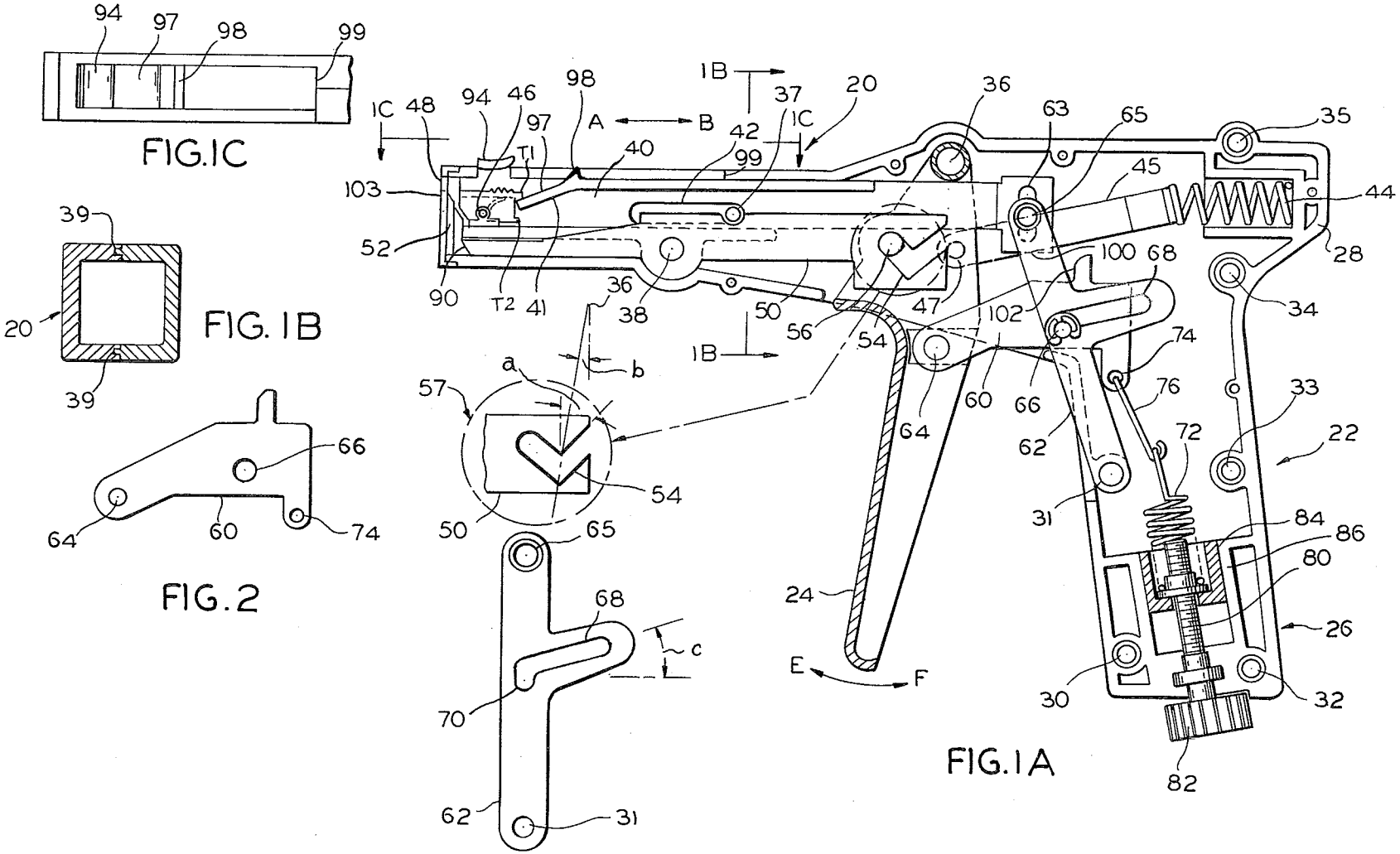
FIG. 1A is an assembled view (with one side removed) of the inventive cable tie gun, showing its levers and slides.
FIG. 1B is a cross section of the barrel end of the housing, taken along line 1B—1B.
FIG. 1C is a plan view looking down upon the end of the barrel of FIG. 1A, taken along line 1C—1C thereof.
FIG. 2 is a plan view of a drive cam.
FIG. 3 is a plan view of a tension bar lever.

The cable tie gun (FIG. 1) comprises a barrel assembly 20, a handle assembly 22, an acuator or trigger 24 and a tension adjuster assembly 26. The gun assembly is here shown as being mounted on one side of a housing 28 in the general shape and form of a hand pistol. The other side of the housing (not showing) fits over the complete assemblies to enclose, protect, and mechanically secure the parts. The two housing parts are then secured and held together by fastener means such as screws or shafts which fit into holes 30–38. Tongues and grooves 39 (FIG. 1B) are formed in the edges of the housing wall to enable the housing parts to resist the urge to move with respect to each other. Some of the screws or shafts are surrounded by bushings so that they also act as anchor or pivot points for the slides or other parts.

The actuator or trigger 24 is mounted on pivot point 36 to swing back and forth in directions E, F, with an excursion over a predetermined arc. If a mechanical interference occurs (FIG. 8) during the swing, the excursion of the actuator does not reach the end of the predetermined arc. However, if the interference does not occur (FIG. 9), the actuator or trigger 24 takes an additional excursion beyond the end of its normal swing. The cable tie is severed at the end of the additional excursion.

The barrel assembly 20 comprises a tension slide 40 which moves back and forth in directions A-B to tension the strap of the cable tie. The limit of such tension slide motion is set by the length of a slot 42 formed in the slide 40. A spring 44 normally urges the entire mechanism to a normal position wherein the tension slide 40 moves as far as it will go in direction A, which is here called the "normal position".

The spring 44 acts through a spring follower 45 upon a pivot point 47 on the actuator handle 24. The pivot point 47 should be removed from the pivot point 36 far enough to establish an adequate lever arm between points 36 and 47, considering the balance of spring forces and considering operator fatigue. If the point 47 is too close to the pivot point 36, the spring 44 becomes so powerful that the tool is too fatiguing to operate. If the point 47 is too far away from the point 36, the tool loses its compact configuration.

A gripper 46 is mounted on the extreme left-hand (as viewed in FIG. 1A) end of tension slide 40, to seize and hold a cable tie strap end when it is inserted through a slot 48 in a pressure plate at the end of the barrel.

Mounted side-by-side with the cable tension slide 40 is a cable tie strap cutoff lever 50, which pivots around a post at 38. A blade 52 is pivotally mounted on one end of the cutoff lever 50, and a cam guide slot 54 is formed in the other end of the cutoff lever. The cam guide slot 54 (outlined by heavily inked lines) includes downwardly slanting and upwardly slanting parts (as viewed in FIG. 1A). An associated cam control shaft 56 is mounted on the actuator or trigger 24 which swings about a post 36 anchored on the housing 28. The shaft 56 may swing through the downward slanting portion of the cam guide slot, without causing any motion in the cutoff arm 50. However, if the guide shaft bearing 56 moves into the upwardly slanting portion of the cam guide slot, the cutoff arm pivots to raise blade 52, and the cable strap is severed.

As with all cutting blades, there is a desired mode of operation and characteristic cutting speed, cutting angle, and the like. These characteristics may be controlled by a proper selection of the contours of cam guide slot 54, as seen in the insert at 57. In a preferred embodiment for cutting cable ties made of currently used materials the center line of the upswept end of the slot forms an angle a of approximately 35°,with respect to the vertical. A line drawn through the valley of the cam slot 54 and the pivot point 36 of the actuator 24 forms an angle *b*, with respect to the vertical. Angle *b*, in a preferred embodiment, is 20°.

The handle assembly 22 comprises a cam drive plate 60 which is pivotally connected at 64 to the trigger 24 and a tension bar lever 62 which is pivotally connected to the housing at 31. Plan views of the cam drive plate 60 and tension bar lever 62 are seen in FIGS. 2, 3, respectively. The cam drive plate 60 is pivotally attached to the trigger 24 at point 64, and the tension bar lever 62 is pivotally attached to the housing at point 31. Preferably, there are a pair of tension bars 62 positioned on opposite sides of cam drive plate 60 and tension slide 40, (only one tension bar lever 62 is seen in FIG. 1A, since the second lever is directly beneath it.) The upper ends 65 of the tension bar levers 62 are connected to and slidingly received a slot 63 in the rear end of the tension slide 40. The cam drive plate 60 preferably has a shaft and stud or roller 66 permanently affixed thereto. The tension bar lever 62 contains a cam slot 68 terminated at the left-hand end (as viewed in FIG. 3) in a cove 70 and on the right-hand end in an upsweeping slot. The dimensions of the cam and cove are designed to receive and guide the stud 66. A spring 72 is connected between a hole 74 in the cam drive plate 60 and the tension adjusting assembly 26. A shackle or hinge connector 76 may be interposed between the spring 72 and hole 74 in the cam drive plate 60. The spring 72 blases cam drive plate 60 to hold the stud 66 in the cove 70 of the tension bar lever, with a predetermined force which is adequate to cause cam plate 60 and tension bar lever 62 to move as a unit if the tension in the cable tie strap does not exceed the tension in spring 72.

The upswept slot end forms an angle *c* (FIG. 3) with respect to the horizontal. This angle *c* is designed to always provide a cam surface wherein shaft 56 is directed toward the capture slot 70, by the force of a vector generated by spring 72 when the slot 68 is at the minimum inclination which occurs on the cutting stroke (FIG. 9). In one preferred embodiment, the angle *c* is approximately 10° with respect to the horizontal.

The tension adjusting assembly 26 comprises a screw 80 projecting out of the bottom or butt end of the handle of the gun. A knurled of fluted head 82 is integrally formed on the screw 80 so that it may be easily rotated responsive to finger pressure. Responsive to a turning of the screw 80, a follower 84 raises or lowers in a guide way 86, formed or molded in the handle. The follower pre-sets a tension spring 72 by a preselected force which is matched to the desired cable tie tension.

A suitable window (not shown) may be formed in the grip end of the gun housing so that the position of follower 84 may be seen. A suitable scale may be supplied adjacent the window in order to convert the pre-tension of spring 72 (i.e., the follower 84 position) into a desired cable tie strap tension.

Figure 4:
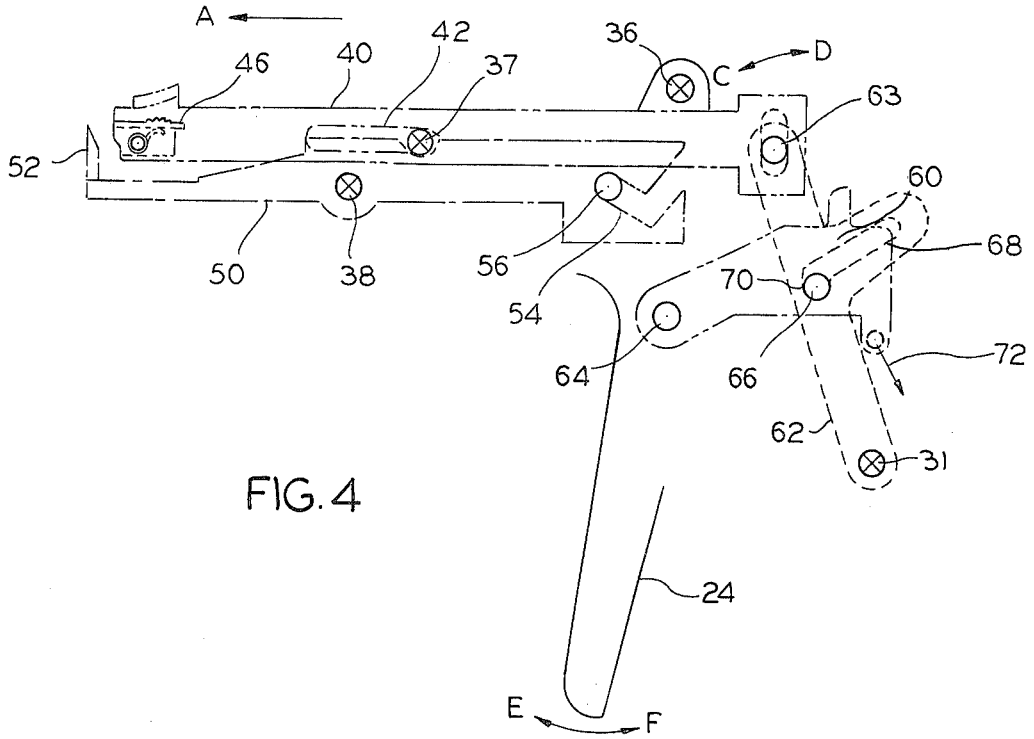
FIG. 4 shows the tensioning and severing mechanisms at the normal condition.

The nature of the gun may become more apparent from a step-by-step description of its operation, as shown in FIGS. 4, 8 and 9. Those parts of these figures, which are the same as the above-described parts are identified by the same reference numerals. The system ground or anchor points are marked by "*x*" marks.

In FIGS. 4, 8, 9, the pertinent parts are drawn in their normal operating positions. However, the various plates over-lie each other, so that they would conceal each other, if they are shown as the solid members that they are. Therefore, so that the parts may be better seen, they are drawn as if they were transparent and they are identified by encoded lines. The outlines of the tension slide 40 and the cam drive plate 60 are shown by double dot, dashed lines. The rocking arm 50 and its attached cutter blade 52 are shown by a single dot-dashed line. The tension bar lever 62 is shown by dashed lines. The trigger 24 is shown by solid lines which are interrupted so that they appear to pass under the other parts.

FIG. 4 shows the normal position of the gun and its parts when it is not in use. The spring 44 (FIG. 1) urges tension slide 40 as far as it will go in direction A. Actuator 24 is connected to tension bar 40 via cam drive plate 60. This drive plate 60 and tension bar lever 62 are connected in series by stud 66 which is held in cove 70 under the urging of spring 72. Thus, all parts are either connected to or controlled by the tension slide 40. They too are moved to their normal position, under the urging of spring 44.

At this time, the extremity of the tension slide motion in direction A is fixed by the rear of slot 42 which is abutting against a screw or shaft 37 mounted in the housing. The upper end of tension bar lever 62 is pulled in direction C. Spring 72 holds stud 66 in cove 70 so that cam drive plate 60 pushes trigger 24 in direction E.

Figure 5:
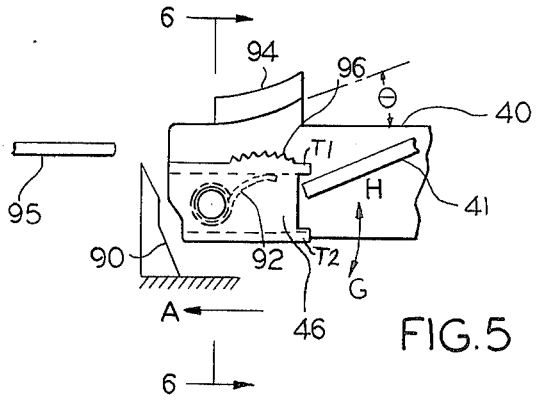
FIG. 5 is a side elevation view of the strap gripper in the non-gripping position.
Figure 6:
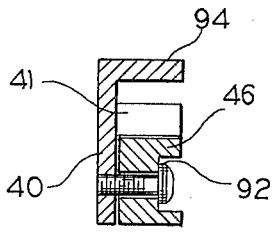
FIG. 6 is a cross-sectional end view (taken along line 6—6 of FIG. 5) of the strap gripper in the non-gripping position.
Figure 7:
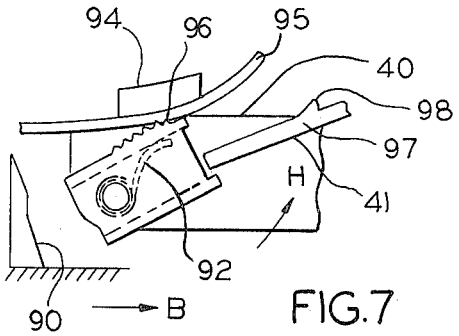
FIG. 7 is a side elevation of the strap gripper showing how it deflects the end of the strap during and as part of the gripping action.

In the forward position, the tension slide 40 presses pivoted gripper mechanism 46 (FIG. 5) in direction A and against a cam surface 90 built into the internal front wall of the gun barrel. Surface 90 forces the gripper 46 to pivot in direction G and against the force of a hair spring 92. A tab 94 on the tension slide 40 is folded (FIG. 6) over the gripper 46, and set at an angle $\theta$ (FIG. 5) with respect to the length of slide 40. The bottom of the tab 94 is rounded to form an arc over which the strap end of the cable tie deflects. The angle $\theta$ may be in the order of 10°–15°, for example. When the gripper 46 is in this position, it is easy to insert the end 95 of the cable tie between the gripper and the tab 94.

The upper edge of the tension slide 40 is folded over or otherwise formed into a downwardly inclined surface 97 behind the gripper mechanism 46 for guiding and directing the strap end, of the cable tie, as it is inserted into slot 48 of the cable tie gun. The front end of the surface 97 confronts the gripper mechanism 46, which has upper and lower tabs T1, T2 that are always above and below that end. The rear end of edge 97 raises to an elevated ramp position at 98 which is higher than an edge 99 of the housing which is likely to be encountered by the cable tie end. This ramp is useful when the cable tie gun is used with a bent end tie, as shown in FIG. 10.

More particularly, this type of cable tie has a permanent bend near its end, as shown at 101. The cable tie which may be inserted through slot 48 with the bent tip projecting either upwardly or downwardly, depending upon the needs of a particular installation. If the tip projects upwardly, there is no problem because it automatically raises above the edge 99 of the housing. However, if the strap is inserted so that the tip projects downwardly, it might be possible that it could engage the housing edge 99 and perhaps become lodged therein. This cannot happen in the inventive gun because the ramp 98 causes the tip end to rise high enough to clear the housing under the worst case conditions.

When the slide 40 begins to move back in direction B, the end of gripper 46 moves away from its contact with the cam surface 90. The spring 92 causes gripper 46 to rotate in direction H, where teeth on the gripper take a bite on the cable tie strap 95.

It is important to note that because tab 94 is set at the angle $\theta$ and because of the arcuate shape on the bottom of the tab 94, the gripper 46 presses against and bends the cable tie strap 95 so that it is inherently deflected upwardly and away from the gun. This way, there is no danger that, after it is severed, the cable tie end 95 may become wedged in the gun. Also, there is no need to provide deflection surfaces on the housing of the gun.

There is an important advantage to this form of deflection surface since the cut end of cable tie normally falls away from the inventive cable tie gun. If, for any reason, the cut strap end should remain in the gun, it will readily fall out under the force of gravity, if the gun is merely turned with the side seen in FIG. 1A facing downwardly. Prior art cable tie guns have sometimes tended to retain the cut cable tie ends so that an operator had to manually pull them from the gun.

The trigger 24 is squeezed in direction F (FIG. 8) and the resulting force is transmitted through the series connected members 60, 62 to tension bar 40. During the resulting motion, the shaft 56, which is immovably attached to trigger 24, swings through a limited excursion of arc I-J centered on the pivot point 36. This arc coincides with the downwardly extending contours of the cam slot 54 so that there is no effect upon either the rocker arm 50 or blade 52 at the end of the rocker arm.

Cam drive plate 60 is also moved in direction F by forces transmitted from the trigger 24 through the pivot point 64. At this time, the stud 66 is being held in cove 70, under the urging of spring 72. Therefore, the force exerted in direction F is transmitted from stud 66 through the side walls of cove 70 to the tension bar lever 62. As this force is so transmitted, the upper end 65 of the tension bar lever 62 swings in direction D. This transmitted force pulls tension slide 40 in direction B to, in turn, pull the strap end 95 of the cable tie. The lock end of the cable tie is held by a pressure plate 103 containing slot 48 at the barrel end of the gun (FIG. 1).

Interference surfaces 100, 102 are formed on the two movable parts of the tension slide 40 and the cam drive plate 60. After these two moving parts 40 and 60 move back far enough in directions B, F, their interfering surfaces 100, 102 abutt against each other and further motion is not possible. Hence, the trigger 24 is stopped at the end of the tensioning stroke and before it has taken the full and complete excursion in direction F, into the cutting stroke. Also, because of the interference, the cam drive plate 60 is restrained at 100, 102 and prevented from rising in direction K. Therefore, it is not possible for stud 66 to escape from cove 70.

Initially, the gun tensioning motion depicted by FIG. 8 merely takes up slack in the cable tie 95. At this time the cable tie tension, represented by the arrow 104, does not equal the pre-set tension in spring 72. When the trigger 24 is released, spring 44 (FIG. 1) pushes all parts back to the normal position of FIG. 4. The shapes of the teeth on the gripper 46 are such that, during strap tensioning motion in direction B, they grip the strap. The motion in direction A causes the teeth to slide over the strap end without gripping it. When the trigger is released, the cable tie remains locked upon itself, in the position to which it was drawn during the tensioning motion of FIG. 8. This tensioning process (FIG. 8) may be repeated many times.

Upon reflection, it should be apparent that, responsive to the forces represented by various alphabetically identified arrows, the two shell halves tend to experience a twisting motion, with respect to each other. If not restrained, they might tend to separate. This separation is precluded by tongues and grooves 39 (FIG. 1B) formed along the edges of the housing. In greater detail, the housing of the cable tie gun 20 has a pair of opposed shells (one of which is seen in FIG. 1A) which fit together in a face-to-face relationship (as seen in FIG. 1B). Together, these opposed shells form a tool housing in the general shape of a handgun having a barrel, a handle, and a trigger. Upon an actuation of the trigger, tension forces occur within the housing, which are translated to the system ground points (indicated by "X" marks in FIGS. 4, 8 and 9) on the opposed housing shells. These tension forces, represented by various alphabetically identified arrows, tend to urge the shells to move with respect to each other, especially in the barrel region of the gun. The tongues and grooves 39 (FIG. 1B) provide a means for holding the two shell halves together in a rigid and immovable relationship. Thus, the opposed housing shells resist the urge to move with respect to each other.

Eventually, the cable tie reaches the desired predetermined tension, at which time the tension slide 40 is immobilized and the surplus end of the strap is cut off (FIG. 9). At the end of the full and complete trigger excursion and after it has traveled beyond the limited tensioning excursion which is stopped by the interference between the surfaces 100, 102, on the two movable parts, rocker arm 50 swings blade 52, to cut strap 95.

In greater detail, there comes a time when the effect of tension in the strap 95 (as indicated by arrow 104)

exceeds the effect of tension in spring 72 (FIG. 9). The strap tension holds the tension slide 40 mid-way in its stroke. While the strap 95 so holds the tension slide 40 immobile in such a mid-stroke position, the interference surface 100 is also held at a mid-stroke position. The mating interference surfaces 100, 102 do not make contact. When this happens, a continued pressure (in direction F) on the trigger 24 causes the stud 66 to pop out of cove 70 when the tension of spring 72 is overcome. When the stud 66 leaves cove 70, the series connection of members 60, 62 collapses, and the stud 66 travels through the length of the cam area 68, thereby enabling the trigger 24 to take an excursion beyond the full arc permitted by the interference between the two moving parts 40 and 60.

The blade 52 cuts the cable tie strap during the last part of the full excursion of the actuator (i.e., while the stud 66 moves through the slot 68 of the cam drive plate). In greater detail, during the cable tensioning step (FIG. 8), bearing 56 swings through only the downward part of the slot 54 defined by arc I-J. Hence, the bearing 56 does not produce any motion in the rocker arm 50. The interference between surfaces 100, 102 stops the motion of the bearing 56 before it reaches the upward part of slot 54.

However, on the cutting stroke (FIG. 9) the tension in strap 95 holds the slide 40 so that it cannot move backward. The continued squeezing of trigger 24 creates a force exceeding the pull of spring 72. The stud 66 pops out of cove 70 and the trigger 24 may move back over its full excursion and as far as the slot 68 will permit. At this part of trigger movement, the bearing 56 passes through the upward part of slot 54, which is an arc L-M. As a result, the rocker arm 50 is forced to swing around the pivot point 38. The blade 52 raises and the free end 95 of the cable tie strap is cut, as shown at 110.

It is important that the cam slots 68 and 54 have a correct profile. At the rear most point in the slot 68, the stud 66 must be on an inclined plane directed toward the cove 70. This way, the force of spring 72 is always urging the stud toward the capture slot. This is distinguished from the type of slot where the right-hand end might become low enough to cause an over center toggle action. In that case, there might be a stable position at the end of the stroke where spring 72 would tend to lock the action. Then, spring 44 would have to be strong enough to overcome the toggle action, which would tire the operator. The right-hand end of the slot 54 must rise sharply enough to cause the blade 52 to move at the cutting speed appropriate for the particular material and to cut the cable tie. Yet, it should not move so abruptly that the operator must cut the strap on too short a stroke of the actuator handle, which is also tiring.

The tensioned cable tie CT surrounds a bundle of wires W and its free end is locked in the locking end LK of the cable tie. The tension in cable tie CT surrounding wires W is a function of the tension in spring 72 (as selected by adjusting mechanism 26) at the time when the stud 66 popped out of the cove 70. The surplus end 95 of the cable tie CT is cut off at a point at or beyond the locking end LK so that there is no effect upon the security of the locked cable tie CT.

Those who are skilled in the art will readily perceive how to modify the system. Therefore, the appended claims are to be construed to cover all equivalent structures.

I claim:

1. A cable tie gun comprising an actuator, mounted for an excursion over a predetermined arc, cable tie tensioning slide bar means mounted for reciprocal motion responsive to operation of said actuator in order to tension a strap of a cable tie, force transmitting means comprising a pair of members connected in series between said actuator and said tension slide bar, said pair of members being interconnected by a stud on one member held in a cove on another member under a preselected spring tension, means responsive to a movement of said actuator means through a limited excursion which is less than said predetermined arc for causing an interference between said tensioning slide bar and said pair of members, said interference preventing a full actuator excursion through the full swing of said predetermined arc and further preventing said stud from leaving said cove, means responsive to a tension in the strap of a cable tie for holding and immobilizing said slide bar means with a force which is greater than said predetermined spring tension, whereby said stud may slip out of said cove if said interference does not occur before the end of the limited excursion permitted by the interference, and thereby enable the actuator to take its full excursion, and means responsive to said full excursion of said actuator and effecting the range extending beyond said limited excursion where said interference normally occurs for severing the strap of a cable tie whereby said strap severing means operates only at the end of said full excursion and independently of the point in said excursion where the force of the strap tension exceeds the predetermined spring tension to immobilize the tensioning means.

2. The cable tie gun of claim 1 wherein said strap severing means comprises a rocker arm having a blade at one end and a cam surface at the other end, bearing means on said actuator for cooperating with said cam surface, said cam surface being shaped so that there is no effect upon said rocker arm responsive to said limited excursion of said actuator.

3. The cable tie gun of claim 2 wherein said cam surface is further shaped to rock said arm after said actuator travels beyond its limited excursion and to the end of the predetermined arc.

4. The cable tie gun of claim 3 wherein said cam surface has a contour which matches the cutting speed of said blade with the cutting characteristics of said strap.

5. The cable tie gun of claim 3 wherein said gun is in a housing in the shape of a hand pistol, having a barrel portion and a butt portion, said cable tie tension slide bar being mounted in the barrel portion of said housing with a return spring between said slide bar and said housing, whereby all parts are normally urged to a normal position, and a second spring connected between one of the pair of numbers and the butt portion of said housing, and means on said butt portion for adjusting the tension of said second spring.

6. The cable tie gun of claim 1 wherein one of said series of members contain a generally L-shaped slot, said cove being formed at the short end of said L, the long end of said L having an orientation wherein said spring tension always urges said stud toward said cove throughout the full excursion of said actuator, whereby a toggle action is precluded.

7. A cable tie gun comprising pressure plate means for holding immobile one end of a cable tie strap, an elongated strap tension slide means mounted for movement between normal and off-normal positions, gripper assembly means mounted entirely on and movable with an end of said tension slide means for gripping and tensioning the other end of said cable tie strap, said gripper assembly comprising a tab overlying a pivoted gripper mechanism, means for automatically moving said gripper mechanism to a strap receiving position when said slide is moved to said normal position next to said pressure plate, and means responsive to a movement of said slide to an off-normal position away from said pressure plate for pivoting said gripper mechanism to grip said other strap end between said mechanism and said tab, the contours of said tab and the angular movement of said gripper mechanism being such that said strap is bent to deflect it away from said cable tie gun while said gripper mechanism is gripping said strap end.

8. The cable tie gun of claim 7 and means for severing an end of said strap after it is tensioned and said contours are arcuate so that the severed end of said strap falls from said gun.

9. The cable tie gun of claim 7 wherein said tension slide means has an inclined surface behind the gripper mechanism for guiding and directing said other end of said strap, said surface rising to an elevated ramp which is higher than adjoining parts of said gun.

10. A method of tensioning cable ties comprising the steps of:

(a) operating a movable actuator connected to a movable cable tie tensioning means;

(b) moving said tensioning means and said actuator means toward a common point of mechanical interference beyond which said tensioning means and actuator mutually preclude each other from taking further movement;

(c) restraining and immobilizing said tensioning means when said cable tie reaches a predetermined tension whereby said interference does not occur;

(d) said actuator moving further when said interference does not occur, and (e) severing said strap at the end of said further movement.

11. The method of claim 10 wherein step (b) includes the added step of transmitting a tensioning force from said actuator through a series connected plurality of members to said tensioning means, step (c) includes the added steps of series connectioning two elongated members, and of collapsing said series connection when said tensioning means encounters a predetermined resistance, and said severing of step (e) occurs after and responsive to the collapse of said series connection of said members.

12. The method of step 11 wherein said severing is performed by a blade connected to a rocker arm and the added step of:

(f) enabling said actuator to move to the point of said interference without substantially moving said rocker arm or severing said strap; and (g) causing said rocker arm to move and severe said strap after the collapse of said series connection of said numbers.

13. The method of claim 12 wherein said tensioning means is an elongated slide bar, and the added step of bending said cable tie at a point near the end of said slide bar responsive solely to a means carried by the end of said slide bar, thereby deflecting said cable tie away from said tensioning.

14. The method of claim 10 and the added step of continuously biasing said tensioning means toward a normal position which is away from said common point of interference, whereby said tensioning means is precluded from moving over center to a stable off normal position.

15. A cable tie gun comprising a pair of opposed shells which fit together in a face-to-face relationship to form a tool housing in the general shape of a hand gun having barrel, a handle, and a trigger, fastener means for securing together said opposed shells, means responsive to actuating said trigger for creating tension forces within said housing which are translated to a system ground points on said opposed shells, whereby said shells are urged to move with respect to each other, especially in the barrel region, and means formed on the edges of the housing wall for holding said two halves in a rigid and immovable relationship, whereby said opposed housing shells resist the urge to move with respect to each other.

16. The cable tie gun of claim 15 wherein said means for holding together the two housing shells are tongue and groove slots on the opposing faces of said two housing shells.

17. The cable tie gun of claim 16 and pair of members connected in series between said trigger and tension force creating means, and means responsive to movement of said trigger for collapsing said series connection responsive to a tension in a strap of a cable tie, and means responsive jointly to the collapsing of said members and said further operation of said trigger for severing said strap.

* * * * *

UNITED STATES PATENT AND TRADEMARK OFFICE

CERTIFICATE OF CORRECTION

PATENT NO. : 4,093,005

DATED : June 6, 1978

INVENTOR(S) : ROBERT M. EBERHARDT, JAMES ARTHUR McNANA, and DENNIS M. HEUER

It is certified that error appears in the above-identified patent and that said Letters Patent are hereby corrected as shown below:

Column 2, line 36, "acuator" should be --actuator--

Column 9, line 47, "connectioning" should be --connecting--

Column 10, line 9, "severe" should be --sever--

Column 10, line 27, before "barrel" insert --a--

Signed and Sealed this

*Seventh* Day of *November 1978*

[SEAL]

*Attest:*

RUTH C. MASON
*Attesting Officer*

DONALD W. BANNER
*Commissioner of Patents and Trademarks*